US009488341B2

(12) United States Patent
Nauen

(10) Patent No.: US 9,488,341 B2
(45) Date of Patent: Nov. 8, 2016

(54) FLUORESCENT DEVICE FOR CONVERTING PUMPING LIGHT

(71) Applicant: OSRAM GMBH, Munich (DE)

(72) Inventor: Andre Nauen, Regensburg (DE)

(73) Assignee: OSRAM GmbH, Munich (DE)

( * ) Notice: Subject to any disclaimer, the term of this patent is extended or adjusted under 35 U.S.C. 154(b) by 27 days.

(21) Appl. No.: 14/371,975

(22) PCT Filed: Jan. 8, 2013

(86) PCT No.: PCT/EP2013/050226
§ 371 (c)(1),
(2) Date: Jul. 11, 2014

(87) PCT Pub. No.: WO2013/104627
PCT Pub. Date: Jul. 18, 2013

(65) Prior Publication Data

US 2014/0355244 A1 Dec. 4, 2014

(30) Foreign Application Priority Data

Jan. 13, 2012 (DE) ..... 10 2012 200 486

(51) Int. Cl.

| | |
|---|---|
| ***F21V 14/08*** | (2006.01) |
| ***F21V 9/12*** | (2006.01) |
| ***F21S 10/00*** | (2006.01) |
| ***F21V 9/08*** | (2006.01) |
| ***F21V 13/08*** | (2006.01) |
| *F21V 9/16* | (2006.01) |
| *F21Y 101/02* | (2006.01) |

(52) U.S. Cl.
CPC ..... *F21V 14/08* (2013.01); *F21S 10/002* (2013.01); *F21V 9/08* (2013.01); *F21V 9/12* (2013.01); *F21V 13/08* (2013.01); *F21V 9/16* (2013.01); *F21Y 2101/025* (2013.01)

(58) Field of Classification Search
CPC .... F21S 48/325; F21S 48/326; F21S 10/002; F21S 48/2218; F21V 19/12; F21V 29/30; F21V 29/40; F21V 29/402; F21V 29/502; F21V 29/56–29/59; F21V 14/08; F21V 9/08; F21V 13/08; H01J 65/04; H01L 33/501; H01L 33/505
USPC ..... 362/318
See application file for complete search history.

(56) References Cited

U.S. PATENT DOCUMENTS 3,602,295 A * 8/1971 Klaas ..... B60H 1/3204 165/202
2005/0063197 A1 3/2005 Nightingale (Continued)

FOREIGN PATENT DOCUMENTS

CH 677846 6/1991
CN 101073025 11/2007

(Continued)

*Primary Examiner* — Anh Mai
*Assistant Examiner* — Steven Horikoshi
(74) *Attorney, Agent, or Firm* — Cozen O'Connor

(57) ABSTRACT

A phosphor device (1) for converting pump light into converted light comprising: a container (3), wherein phosphor particles (5) are movable by a pressure fluid, and an illumination region (9), configured for an illumination of the phosphor particles (5), which are moved by pressure fluid, using pump light, as a result of which converted light is emitted.

15 Claims, 3 Drawing Sheets

(56) References Cited

U.S. PATENT DOCUMENTS

| | | | | |
|---|---|---|---|---|
| 2005/0168990 | A1* | 8/2005 | Nagata | F21V 29/30 362/294 |
| 2007/0019408 | A1 | 1/2007 | McGuire, Jr. et al. | |
| 2007/0047868 | A1 | 3/2007 | Beaulieu et al. | |
| 2007/0131954 | A1 | 6/2007 | Murayama et al. | |
| 2009/0034284 | A1 | 2/2009 | Li et al. | |
| 2011/0280033 | A1* | 11/2011 | Kishimoto | F21S 48/1145 362/543 |
| 2012/0069593 | A1* | 3/2012 | Kishimoto | B60Q 1/076 362/511 |

FOREIGN PATENT DOCUMENTS

| | | |
|---|---|---|
| DE | 10 2007 054 039 | 3/2009 |
| WO | WO 85/05167 | 11/1985 |
| WO | WO 2012/042441 | 4/2012 |
| WO | WO 2013/023663 | 2/2013 |

* cited by examiner

Fig. 1b
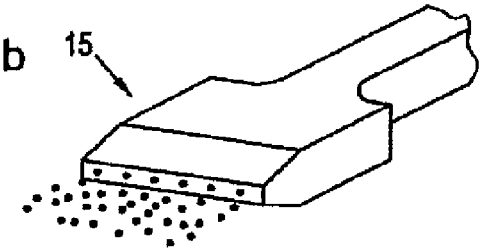
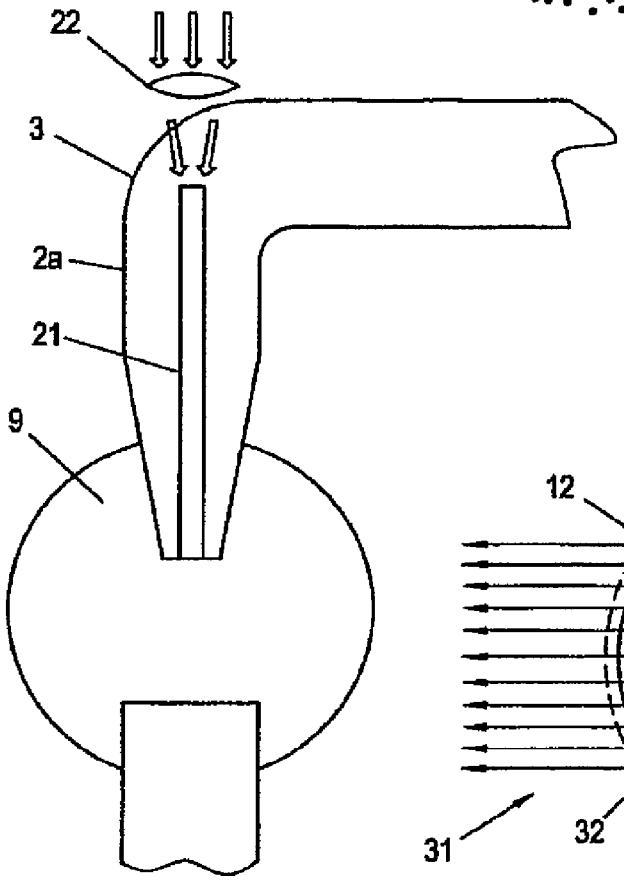
Fig. 2
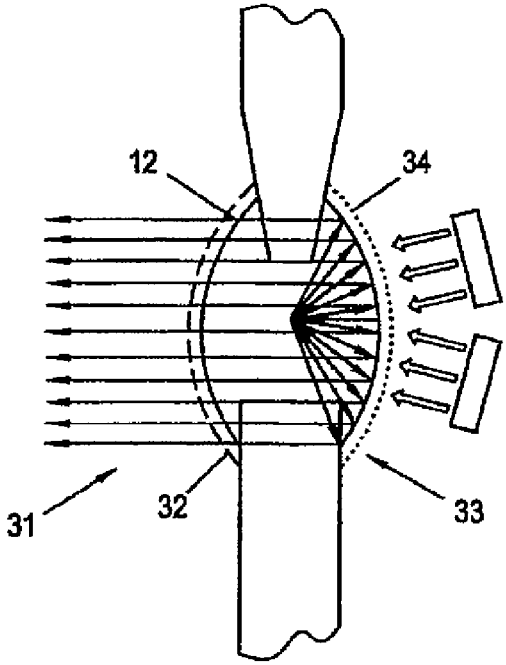
Fig. 3

Fig. 3a
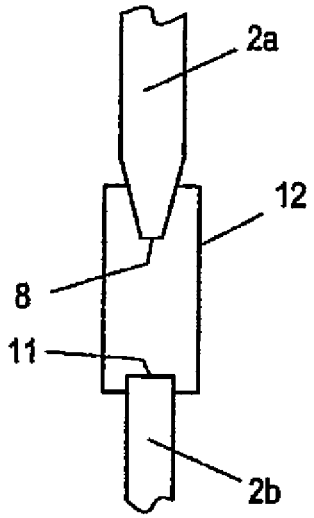
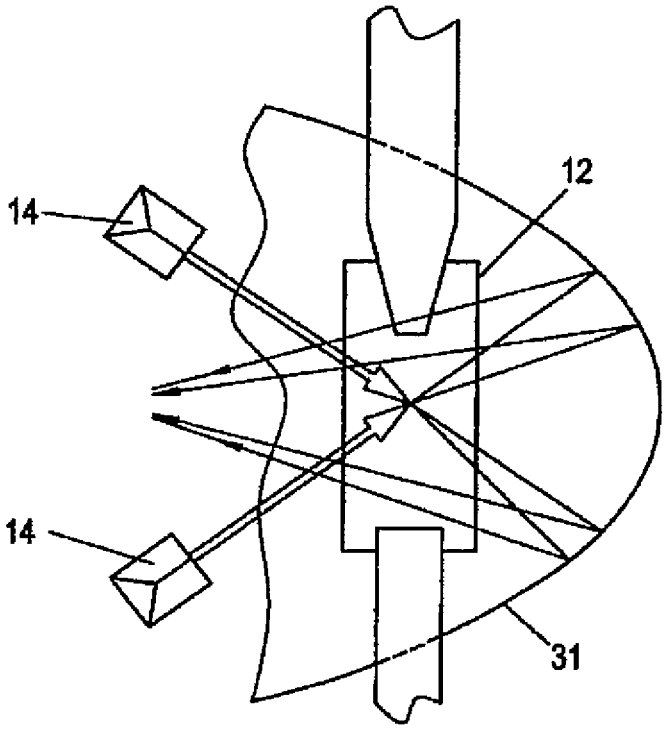
Fig. 3b

FLUORESCENT DEVICE FOR CONVERTING PUMPING LIGHT

RELATED APPLICATIONS

This is a U.S. National stage of International application No. PCT/EP2013/050226 filed on Jan. 8, 2013.

This patent application claims the priority of German application no. 10 2012 200 286.6 filed Jan. 13, 2012, the disclosure content of which is hereby incorporated by reference.

FIELD OF THE INVENTION

The present invention relates to a phosphor device for converting pump light into converted light.

BACKGROUND OF THE INVENTION

Light sources of high luminance are used in greatly varying fields, in endoscopy and also in projection devices. The most recent developments relate in this case to the combination of a pump light source of high power density, for example, a laser, with a phosphor element which converts pump light, and which is arranged spaced apart from the pump light source. A conversion of ultraviolet or blue pump light, for example, into converted light of longer wavelength occurs by way of the phosphor element, specifically a phosphor provided on a carrier in layer form.

SUMMARY OF THE INVENTION

One object of the present invention is to provide a phosphor device for converting pump light which is advantageous in relation to the prior art.

This object is achieved according to one aspect of the invention directed to a phosphor device having a container, in which phosphor particles are movable by means of a pressure fluid, and an illumination region, which is designed for an illumination of the phosphor particles, which are moved by pressure fluid, using pump light, as a result of which converted light is emitted.

In contrast to the prior art, the phosphor particles, which can have a size of a few tens of nanometers up to millimeters (typical values are between 1-30 μm), are not fixed in their relative position to one another, but rather can be moved per se by means of the pressure fluid in a volume delimited by the container. The pressure fluid enclosing the individual phosphor particles in this case, for example, a liquid or in a preferred embodiment a gas (including a gas mixture) is advantageously not only used to move the phosphor particles in this case, but rather also to cool them. Excess heating of the phosphor and an efficiency decrease accompanying it can therefore be avoided in the light conversion.

In this context, the movement of the phosphor particles can also advantageously come to bear, for example, if each phosphor particle per se only remains for a brief period of time in a region illuminated using pump light (referred to hereafter as a "pump light cone" independently of the shape for the sake of simplicity) and is then moved back out of the pump light cone. The mean illumination duration of the individual phosphor particles can thus also be reduced in relation to a static phosphor element, for example, which, while avoiding excess heating, limits the energy introduction into a phosphor particle.

Depending on the selected pressure fluid, i.e., in particular its transmission properties, the pump light can also be blue or ultraviolet, for example, and can be emitted by a laser or an LED, for example. In the scope of this disclosure, "light" means electromagnetic radiation very generally, i.e., it is not necessarily restricted to the visible wavelength range; the term "illumination" is also correspondingly general. The pump light can also be, for example, ultraviolet light or even corpuscular radiation, for example, an electron beam or ion beam, however, laser light or LED light is preferred. The pump light is also not necessarily limited to a specific spectral range; for example, pumping can be performed in the red, green, blue, and/or ultraviolet spectral range, for example, by a corresponding pump light source or also a combination of multiple pump light sources.

Insofar as specifications are made on the emission and propagation of light or the movement of phosphor particles is described in the present case, this does not imply that the propagation or movement must also actually occur; rather, an assembly is described, which is designed for a corresponding light propagation or movement of the phosphor particles.

The phosphor particles can be dispersed in a liquid, for example, which is then continuously mixed through in the container, for example, by stirring. For example, an immersion liquid can be provided as a liquid, for example "Immersol 518F" from Zeiss. However, the phosphor particles can also be swirled by gas action, for example, and thus moved through the pump light, for example, by gas pressure surges. In any case, the illumination region is at least partially filled with pressure fluid and phosphor particles in operation; pump light is then coupled into the illumination region and converted light is decoupled.

The illumination region, i.e., a volume provided for the illumination of the phosphor particles, is preferably delimited by a wall, which is transmissive for pump light and converted light. If a gas is provided as the pressure fluid, for example, this can be an inert gas in this case, i.e., for example, nitrogen and/or a noble gas or noble gas mixture, such as xenon and/or argon.

In a preferred embodiment, the container is implemented as at least partially tubular and delimits a channel, in which the phosphor particles are movable by means of the pressure fluid, i.e., a gas or a liquid, for example, as a phosphor particle beam (also referred to hereafter as a "particle beam"; in other compound words, "phosphor particles" are abbreviated similarly). The phosphor particles are thus preferably moved as a particle beam through the illumination region.

A movement path is predefined for the phosphor particles moved by the pressure fluid due to the tubular container, the extension of which in the extension direction measures a multiple of that perpendicular thereto, on the one hand; these particles can also, for example, in contrast or in addition to the "swirling" mentioned at the outset, be moved intentionally through the pump light cone. On the other hand, the flow speed of the pressure fluid is also increased by the extension of the channel delimited perpendicularly to the extension direction, so that the phosphor particles can also accordingly be moved more rapidly through the pump light cone, which further reduces the heating.

"Particle beam" means phosphor particles moved within a specific flow cross section, which is also variable along the extension direction of the channel, by means of the pressure fluid. In this case, the flow cross section is the area respectively actually filled by the particle beam (and therefore by pressure fluid and phosphor particles) perpendicular to the extension direction, which can also be smaller than the cross-sectional area of the channel.

The flow cross section of the particle beam in the illumination region is preferably constricted in relation to that in an upstream channel region, so that the phosphor particles can be moved in the illumination region with increased speed in relation to the upstream channel region and the particle density can also be increased. To reduce the flow cross section, the channel can be constricted in the illumination region by a corresponding tube section (which is transmissive for pump light and converted light) of smaller internal diameter, for example. The tube would thus be constricted similarly to a bottleneck in the illumination region, for example, and could be widened again downstream from the illumination region, i.e., in a mirror image to the constriction.

However, a nozzle, which opens with an outlet opening into the illumination region, preferably adjoins the upstream channel region. The nozzle tapers the flow cross section upstream from the outlet opening; the outlet opening opens into the illumination region, which is delimited by a wall in a preferred embodiment, for example, like a bulb. The wall is preferably at least transmissive in a region for pump light or converted light, respectively. In any case, in spite of a channel cross section widened downstream from the outlet opening, the flow cross section of the particle beam is tapered (the particle beam does not completely fill up the channel section available downstream from the nozzle).

The particle beam exits from the nozzle with an increased speed in relation to the channel region upstream from the nozzle, which means a further reduced illumination duration for the pump light illumination (downstream from the nozzle).

Furthermore, the concentration of phosphor particles is also increased and accordingly the light yield is improved immediately downstream from the nozzle. For example, the nozzle can be embodied as a single material pressure nozzle, a turbulence nozzle, or a nozzle which forms lamellae.

In general, a minimum flow speed of the pressure fluid can be selected as a function of the size of the phosphor particles, i.e., for example, adapted to the sedimentation speed thereof, for example. For particles having a diameter of 100 μm, for example, the sedimentation speed in air at 1000 hPa is approximately 0.1 m/s; at a particle size of 1 μm, the sedimentation speed is approximately $10^{-5}$ m/s. To ensure a sufficient particle transport, the flow speed should preferably correspond to at least ten times the sedimentation speed; for example, in the case of particles having a mean diameter of 100 μm, it should therefore be at least 1 m/s.

These are minimum flow speeds; maximum flow speeds can be predefined by the technical framework conditions in the gas stream generation, for example. However, boundary conditions can also be predefined, for example, by an abrasion of individual components occurring in the case of excessively high flow speeds, i.e., for example, "sandblasting" of the illumination region wall, or, for example, also by a desired restriction of the noise emission. A flow speed of at least 1 m/s is thus preferable; a flow speed of 10 m/s is particularly preferably not exceeded, independently of the lower limit.

If a liquid is provided as the pressure fluid, the sedimentation speeds are reduced by approximately three orders of magnitude in a correspondingly viscous liquid in relation to a gas, specifically as a result of the higher density of the liquid than the gas. A minimum flow speed can also be selected to be correspondingly less, i.e., it can already be sufficient at 1 mm/s, for example. The technical framework conditions are also again limiting on the upper end, wherein a preferred maximum flow speed is 10 cm/s; a minimum flow speed of 1 mm/s is furthermore preferable and is independent of this upper limit.

In a preferred embodiment, a flat nozzle is provided, the outlet opening is thus not circular or ring-shaped, for example, but rather implemented as elongated transversely (preferably perpendicularly) to the extension direction. A planar form is thus predefined for the pressure fluid and therefore the particle beam, for example, in contrast to a conical form. The width can be adapted in this case to the cross section of a pump light beam, wherein a "thickness" of the particle beam taken in the pump light incidence direction can be kept correspondingly thin to a static phosphor element. A nearly planar light source may therefore be implemented.

Since the excited phosphor states only have a very short lifetime, typically in the sub-microsecond range, in spite of high flow speeds, excitation region and emission region are typically not noticeably different from one another, in any case not substantially. In addition to the reduced energy introduction in the event of increased flow speed, an increased convection which occurs in particular in the case of turbulence can cause additional cooling. In addition, increasing homogenization of the emitted light can also be achieved with rising flow speed, both by spatial averaging and also by chronological averaging.

In a preferred embodiment, a first side of the wall delimiting the illumination region is provided for an exit of the converted light and a second side, which is opposite to the first side, is designed for the purpose of at least partially reflecting the converted light. Due to the at least partial reflection of the converted light, a preferred emission direction is predefined for the light; "at least partially reflective" means reflecting a part of the intensity, preferably at least 50% thereof, at least in one wavelength range. The converted light can thus be provided bundled to an application, for example, a projection device, for example.

The region of the illumination region wall which is reflective for converted light can nevertheless transmit pump light in this case, for example, in the case of a dichroic coating. This advantageously has the consequence that the pump light source or an optic provided for pump light coupling can be arranged on one side of the illumination region and the converted light can be discharged on the opposite side; pump light source or optic thus does not shade the converted light.

The second side, which at least partially reflects converted light, is preferably embodied as a hollow mirror facing toward the particle beam and particularly preferably has a parabolic, elliptical, or aspheric form, at least in sections. In general, the hollow mirror form advantageously bundles the converted light.

If the region of the particle beam coincident with the pump light cone is arranged in the focal point of a parabola, for example, i.e., in the focal point of a correspondingly shaped and coated wall, the converted and then reflected light becomes an approximately parallel beam bundle.

In a preferred embodiment, the first side, which is provided for the exit of the converted light, of the illumination region is designed for the purpose of at least partially reflecting the pump light. This relates, for example, to applications in which a mixture of converted light and pump light (which is generally only partially converted) is not to be made available, but rather solely converted light. This can be advantageous, for example, because in the case of a possibly varying pump light conversion, only the intensity, but not the spectral properties of the light are changed.

In a preferred embodiment, a pump light coupling device is provided in the container and is designed for the purpose of conducting the pump light into the illumination region. In the simplest case, for example, a mirror which reflects pump light into the particle beam can thus be provided in the channel assembly (or also in a non-tubular container described at the outset). This system integration is already advantageous because of the reduced number of individual parts.

If nozzle and pump light coupling device are provided together with a wall delimiting the illumination region as an integrated component, for example, this can be replaced as a whole if, for example, as a result of a "sandblasting effect" of the particle beam, the wall is only sufficiently transmissive over a specific operating duration. Since the pump light coupling device can then already be set to the respective nozzle in such a replaceable component, the alignment effort in the maintenance is reduced.

In a further embodiment of the pump light coupling device, an optical waveguide, for example, an integrator or a glass fiber, is provided in a tubular container, i.e., in the channel delimited thereby. The optical waveguiding occurs in the non-imaging optical waveguide by reflection on boundary surfaces oriented in the extension direction, for example, as a total reflection on the external surface of a glass fiber.

A corresponding optical waveguide provided in the channel, preferably upstream from the illumination region, can also help to reduce shading effects, for example, because a channel structure required in any case for moving the phosphor particles is thus also usable for the pump light supply.

The phosphor device comprises, in a preferred embodiment, a pump which can have a pressure fluid connection to the channel assembly, and is preferably connected thereto. Thus, for example, a jet pump can be provided, which accelerates the phosphor as a suction medium; the propellant medium can be a specific gas or a gas mixture, in the simplest case air, for example, as a function of the required transmission properties, for example. Since no parts have to be moved in operation of a jet pump, the use thereof can be particularly maintenance-friendly (nevertheless, the propellant medium is generally moved by means of mechanically moved components, for example, in the case of a fan or compressor).

Another aspect of the invention relates to an illumination device having an above-described phosphor device and a pump light source, A laser and/or an LED (or a plurality of lasers and/or LEDs) is particularly preferably provided.

Since the light emitted by a laser is generally already substantially bundled in comparison to the light emitted from an LED, i.e., it propagates as a beam having a small beam cross section, the region of the particle beam excited using pump light can also be kept correspondingly small. The emission region is then also correspondingly small, because of which (as a result of maintaining etendue), excitation by means of laser can suggest itself in particular if a high luminance is required, for example, in a light source of an endoscope or projection device.

In contrast, the light emitted from an LED is generally not already bundled, because of which the region of the particle beam illuminated thereby is also correspondingly greater. Overall (added over the emission region), converted light of higher intensity, i.e., having a high light current, can thus be obtained, which can be advantageous in the case of room and object illumination in the architecture field, for example.

Embodiments of an illumination device or phosphor device according to the invention can be used for the above-mentioned purposes, specifically also independently of the embodiment of the pump light source, Furthermore, an aspect of the invention is directed to the operation of such an illumination device.

BRIEF DESCRIPTION OF THE DRAWINGS

Embodiments of the invention will be explained in greater detail hereafter in connection with the drawings, wherein the individual features can also be included in other combinations.

In the specific figures:

FIG. 1*b* shows a flat nozzle for a phosphor device according to FIG. 1;

FIG. 2 shows a channel assembly having integrated glass fiber for pump light coupling;

FIG. 3 shows a phosphor device having dichroic coated illumination region wall;

FIG. 3*a* shows a phosphor device having cylindrical glass bulb;

FIG. 3*b* shows a phosphor device according to FIG. 3*a* having pump light sources and reflector.

DETAILED DESCRIPTION OF THE DRAWINGS

Figure 1:
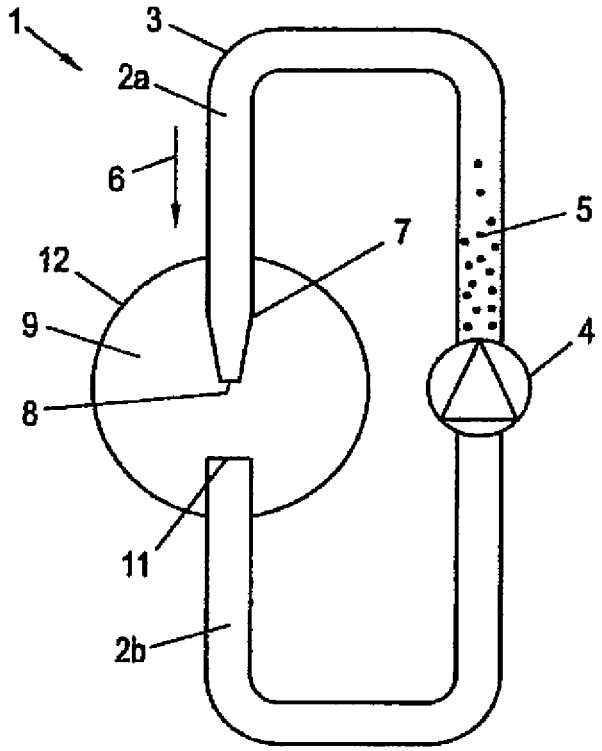
FIG. 1 shows a phosphor device having nozzle and jet pump.

FIG. 1 shows a phosphor device 1 according to the invention having a channel 2*a, b*, which is delimited by a tubular vessel 3. Phosphor particles 5 are movable by pressure fluid, specifically using air as a propellant medium, in the channel 2*a, b* by means of a jet pump 4 (symbolically shown). For the sake of clarity, the phosphor particles 5 are only shown in one channel section; in operation, however, they fill up the entire channel 2 with respect to the extension direction 6 (of the channel 2).

A flow cross section of the particle jet taken perpendicularly to the extension direction 6 is reduced by a tapering nozzle 7 having an outlet opening 8. Therefore, phosphor particles exit from the outlet opening 8 with an increased flow speed in relation to the upstream channel region 2*a*.

The phosphor can be, for example, YAG:Ce (yellow phosphor) and/or BaSrSiN:Eu (red phosphor). Possible phosphors, which can each be used individually or also in any arbitrary combination, are:

$(Ca, Sr)_8Mg(SiO_4)_4Cl_2:Eu^{2+}$ (green),
$(Sr, Ba)_2SiO_4:Eu^{2+}$ (green),
$(Sr, Ba)Si_2N_2O_2:Eu^{2+}$ (green),
$(Y, Gd, Tb, Lu)_3(Al, Ga)_5O_{12}:Ce^{3+}$ (yellow),
$(Ca, Sr, Ba)_2SiO_4:Eu^{2+}$ (yellow),
$(Sr, Ba, Ca)_2Si_5N_8:Eu^{2+}$ (red),
$(Sr, Ca)AlSiN_3:Eu^{2+}$ (red),
$(Sr, Ca)\ S:Eu^{2+}$ (red).

For example, the pump light itself can also be used as a blue light component; however, a conversion can also be performed, for example, by Eu-doped barium-magnesium-aluminate (BAM). As illustrated in the enlarged view of the nozzle 7 in FIG. 1*a*, the particle beam is illuminated using a laser beam 13, which a laser 14 emits, immediately downstream from the outlet opening 8. The mean speed of the phosphor particles 5 is also highest in the region of the outlet opening 8 as a result of the nozzle 7, which tapers the flow cross section, which accordingly helps to reduce the illumination duration of a phosphor particle 5 and therefore its heating.

The phosphor particles 5 are then suctioned in again at an opening 11 opposite to the nozzle 7, guided in a channel region 2*b*, which is downstream from the illumination region 9, to the jet pump 4, and supplied again by means of this jet pump via the nozzle 7 to the illumination region 9; the phosphor particles 5 cool down in this case before every further entry into the pump light cone 10. The cooling can be strengthened still further if the particle beam is guided through a heat exchanger (not shown here).

The illumination region 9 is delimited on the outside by a wall 12, which is transmissive for pump light and converted light, preferably by a glass bulb.

Figure 1A:
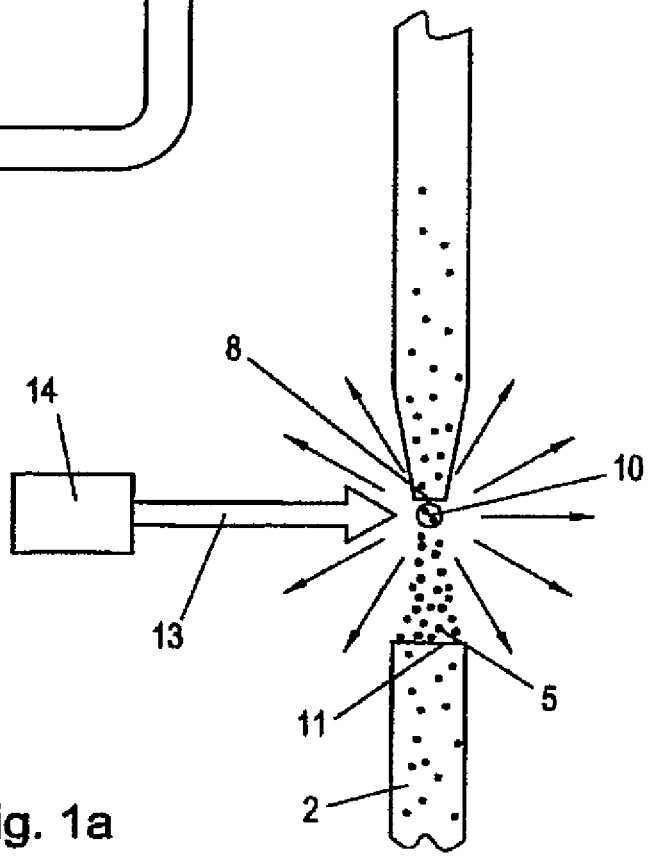
FIG. 1*a* shows an enlarged illustration of the phosphor device according to FIG. 1.

Alternatively to the rotationally symmetrical nozzle 8, which forms a conical particle beam, according to FIGS. 1, 1*a*, a flat nozzle 15 can also be provided, which forms a correspondingly flat particle beam, compare FIG. 1*b*.

The pump light can be incident through the glass bulb 12 on the particle beam, for example (FIGS. 1, 1*a*; in FIG. 1*a*, the glass bulb is not shown for the sake of clarity, however, it corresponds in this regard to FIG. 1). Alternatively thereto, FIG. 2 illustrates an integrated glass fiber 21 as a pump light coupling device, which is introduced upstream from the illumination region 9 into the channel region 2*a* and opens into the illumination region 9 jointly with the outlet opening 8 of the nozzle.

Pump light coupled into the glass fiber 21 can thus be conducted via a lens 22 into the illumination region 9, without converted light being shaded via the tubular container 3, which is required in any case for providing the channel 2*a, b*. (For the sake of clarity, no phosphor particles are shown in FIG. 2; these would exit as a particle beam from the nozzle 7, corresponding to FIG. 1*a*.)

FIG. 3 illustrates, also with regard to an optimization of the light yield, a glass bulb 12 having dichroic coating. On a first side 31 of the glass bulb 12, which is provided for decoupling the converted light (filled arrows) and accordingly faces toward the application, a dichroic layer 32 is applied, which is transmissive for converted light, but is reflective for pump light (non-filled arrows). The application is thus provided solely with converted light without a pump light fraction; the latter is reflected back into the illumination region 9, which increases the pump light yield.

On an opposite side 33, which is provided for the pump light coupling, the glass bulb 12 is provided with a dichroic layer 34, which transmits pump light and reflects converted light. The pump light can thus enter the glass bulb 12, but converted light is reflected on the layer 34. The glass bulb 12 approximates a parabolic shape on the side 33, in the focal point of which the excitation region and accordingly also the emission region are arranged, so that the layer 34 reflects the converted light like a hollow mirror to the opposite side 31.

FIG. 3*a* shows an alternative glass bulb 12 to that according to FIG. 3, which has a cylindrical shape, i.e., is implemented as circular in a section plane perpendicular to the plane of the drawing. The upstream channel region 2*a* opens into the glass bulb 12 with an outlet opening 8 in the above-described manner. An opening 11 is again arranged opposite thereto, via which the particles are suctioned in and thus supplied to the downstream channel region 2*b*.

FIG. 3*b* shows an arrangement explained on the basis of FIG. 3*a*, supplemented by two pump light sources 14, in the present case laser pump light sources, which are provided for illuminating the particle beam exiting from the outlet opening 8. The laser beams are oriented onto the particle beam (not shown for the sake of clarity), i.e., aligned on an illumination region inside the cylindrical glass bulb 12.

In this case, the glass bulb 12 is not mirrored, but rather arranged as a whole inside a reflector 31 to bundle the converted light. The reflector 31 bundles the converted light and provides it to an application. The coupling of the laser beams does not necessarily have to be performed as described above, of course; a laser beam can also be coupled via an opening provided in the reflector 31, for example. The concrete spatial arrangement can also be selected as a function of the framework conditions predefined by the application.

The scope of protection of the invention is not limited to the examples given. hereinabove. The invention is embodied in each novel characteristic and each combination of characteristics, which includes every combination of any features which are stated in the claims, even if this feature or combination of features is not explicitly stated in the examples.

The invention claimed is:

1. A phosphor device for converting pump light into converted light comprising:

a container, in which container phosphor particles are movable by a pressure fluid, and an illumination region, configured to illuminate the phosphor particles, which are moved by pressure fluid, using pump light, as a result of which illumination converted light is emitted, wherein:

the container is at least partially tubular and delimits a channel, in which channel the phosphor particles are movable by the pressure fluid as a particle beam, a flow cross section of the particle beam in the illumination region is constricted in relation to the particle beam in an upstream channel region, and the phosphor device further comprises a nozzle, wherein the nozzle: (a) opens with an outlet opening into the illumination region, and (b) adjoins the upstream channel region.

2. The phosphor device as claimed in claim 1 further comprising a wall, wherein the wall delimits the illumination region and is transmissive for pump light and converted light.

3. The phosphor device as claimed in claim 1, wherein the nozzle is implemented as a flat nozzle.

4. The phosphor device as claimed in claim 1, further comprising a first side of the illumination region provided for an exit of the converted light and a second side of the illumination region, arranged opposite to the first side, the second side being configured to at least partially reflect the converted light.

5. The phosphor device as claimed in claim 4, wherein the second side, which at least partially reflects converted light, has the form of a hollow mirror.

6. The phosphor device as claimed in claim 5, wherein the hollow mirror has a shape selected from the group consisting of: parabolic, elliptical, and aspheric.

7. The phosphor device as claimed in claim 1, further comprising a first side of the illumination region, provided for an exit of the converted light, the first side being configured to at least partially reflect the pump light.

8. The phosphor device as claimed in claim 1, further comprising a pump light coupling device, arranged in the container, the pump light coupling device being configured to conduct the pump light into the illumination region.

9. The phosphor device as claimed in claim 1, further comprising a pump light coupling device arranged in the container, the pump light coupling device being configured to conduct the pump light into the illumination region, wherein an optical waveguide is provided as the pump light coupling device within the channel of the container.

10. The phosphor device as claimed in claim 9, wherein the optical waveguide is one selected from the group consisting of: an integrator and a glass fiber.

11. The phosphor device as claimed in claim 1, further comprising a pump configured to accelerate the phosphor particles as a suction medium.

12. The phosphor device as claimed in claim 11, wherein the pump is a jet pump.

13. An illumination device having a phosphor device as claimed in claim 1 and a pump light source.

14. The illumination device as claimed in claim 13, wherein the pump light source is one selected from the group consisting of: an LED and a laser.

15. A method for operating an illumination device as claimed in claim 13, wherein the phosphor particles are moved by pressure fluid in the container and are illuminated using pump light emitted by the pump light source.

* * * * *